United States Patent [19]

Yukishima

[11] 4,350,010

[45] Sep. 21, 1982

[54] EXHAUST SYSTEM FOR AN OUTBOARD ENGINE

[75] Inventor: Susumu Yukishima, Mamamatsu, Japan

[73] Assignees: Yamaha Hatsudoki Kabushiki Kaisha; Sanshin Kogyo Kabushiki Kaisha, both of Iwata, Japan

[21] Appl. No.: 138,939

[22] Filed: Apr. 10, 1980

[30] Foreign Application Priority Data

Apr. 17, 1979 [JP] Japan ..... 54-47379

[51] Int. Cl.[3] ..... F01N 3/04; F02B 27/04; B63H 21/32

[52] U.S. Cl. ..... 60/310; 60/312; 60/314; 181/251; 181/260; 440/89

[58] Field of Search ..... 60/310, 312, 314; 440/89; 181/251, 260

[56] References Cited

U.S. PATENT DOCUMENTS

| | | | |
|---|---|---|---|
| 1,606,032 | 11/1926 | Kolstrand | 181/260 |
| 3,045,423 | 7/1962 | Hulsebus | 60/310 |
| 3,310,022 | 3/1967 | Kollman | 60/310 |
| 3,520,270 | 7/1970 | Miller | 60/314 |
| 3,577,952 | 5/1971 | Tado | 440/89 |
| 3,771,315 | 11/1973 | Scott | 181/260 |
| 4,015,429 | 4/1977 | Pichl | 440/89 |
| 4,303,401 | 12/1981 | Sanmi | 440/89 |

FOREIGN PATENT DOCUMENTS

| | | |
|---|---|---|
| 51-93597 | 7/1976 | Japan . |
| 53-55192 | 5/1978 | Japan . |

*Primary Examiner*—Douglas Hart
*Attorney, Agent, or Firm*—Donald D. Mon

[57] ABSTRACT

An outboard engine has a casing, an internal combustion engine with a water cooling circuit and an exhaust pipe. The exhaust pipe discharges exhaust gases into an expansion chamber, and gases from the expansion chamber are discharged into the body of water in which the vessel propelled by the engine floats. The exhaust pipe projects into the expansion chamber and has pores (perforations) near its outlet end. Coolant water is discharged into the expansion chamber and mixes with the exhaust gases. Gas flow through the pores discourages reverse flow of water droplets through the exhaust pipe to the engine cylinders.

9 Claims, 2 Drawing Figures

EXHAUST SYSTEM FOR AN OUTBOARD ENGINE

FIELD OF THE INVENTION

The present invention relates to an exhaust system for an outboard engine, and more particularly to improvements in an exhaust system for an outboard engine, in which an exhaust pipe communicating with the exhaust port of the engine is made to protrude into an exhaust expansion chamber in a casing so that the exhaust gases are discharged from said exhaust pipe into said exhaust expansion chamber, and in which engine cooling water is also discharged into said exhaust expansion chamber.

BACKGROUND OF THE INVENTION

In an outboard engine, generally speaking, the exhaust gases are discharged through an exhaust pipe into an exhaust expansion chamber in a casing until they are discharged into water from the lower portion of the casing. In order to cool that portion of the wall surface of the exhaust expansion chamber and other structure which is to be exposed to the exhaust gases, water which was used to cool the engine is discharged into the exhaust expansion chamber, or some water before the engine cooling operation is discharged into the expansion chamber from the vicinity of a water pump for pumping the cooling water until it is discharged into the water together with the aforementioned exhaust gases.

In an outboard engine thus constructed, the cooling water discharged into the exhaust expansion chamber is expanded in the form of droplets into the expansion chamber or wets the outer circumferential wall of the exhaust pipe. In this exhaust pipe, on the other hand, the high pressure waves, which are generated at the instant when the exhaust port of the engine is opened, are propagated in the exhaust pipe toward the leading end thereof, and those positive pressure waves are changed, at the instant when they expand from the leading end of the exhaust pipe into the expansion chamber, into negative pressure waves, which in turn return toward the exhaust port through the exhaust pipe, thus establishing the pulsating phenomena of the positive and negative pressure waves.

As a result, when a vacuum is established in the exhaust pipe, the aforementioned water droplets floating in the vicinity of the leading end of the exhaust pipe and/or the water droplets wetting the outer circumferential wall of the exhaust pipe and reaching the opened lower end of said pipe along the wall surface may be sucked into the exhaust pipe and they may steal into the cylinder of the engine, thus causing a misfire. Especially in case the outboard engine is used on the sea, the brine may wet the inner wall of the exhaust pipe to invite difficulties such as corrosion or increase in passage resistance.

BRIEF DESCRIPTION OF THE INVENTION

In view of the circumstances thus far described, the present invention contemplates to provide an exhaust system for preventing cooling water from being sucked toward the cylinders with the use of a simple construction. In order to attain this objective an exhaust system according to the present invention is characterized in that an exhaust pipe for discharging the exhaust gases into an expansion chamber has its lower wall formed with pores extending therethrough.

The invention will be fully understood from the following detailed description and the accompanying drawings, in which:

DETAILED DESCRIPTION OF THE DRAWINGS

Figure 1:
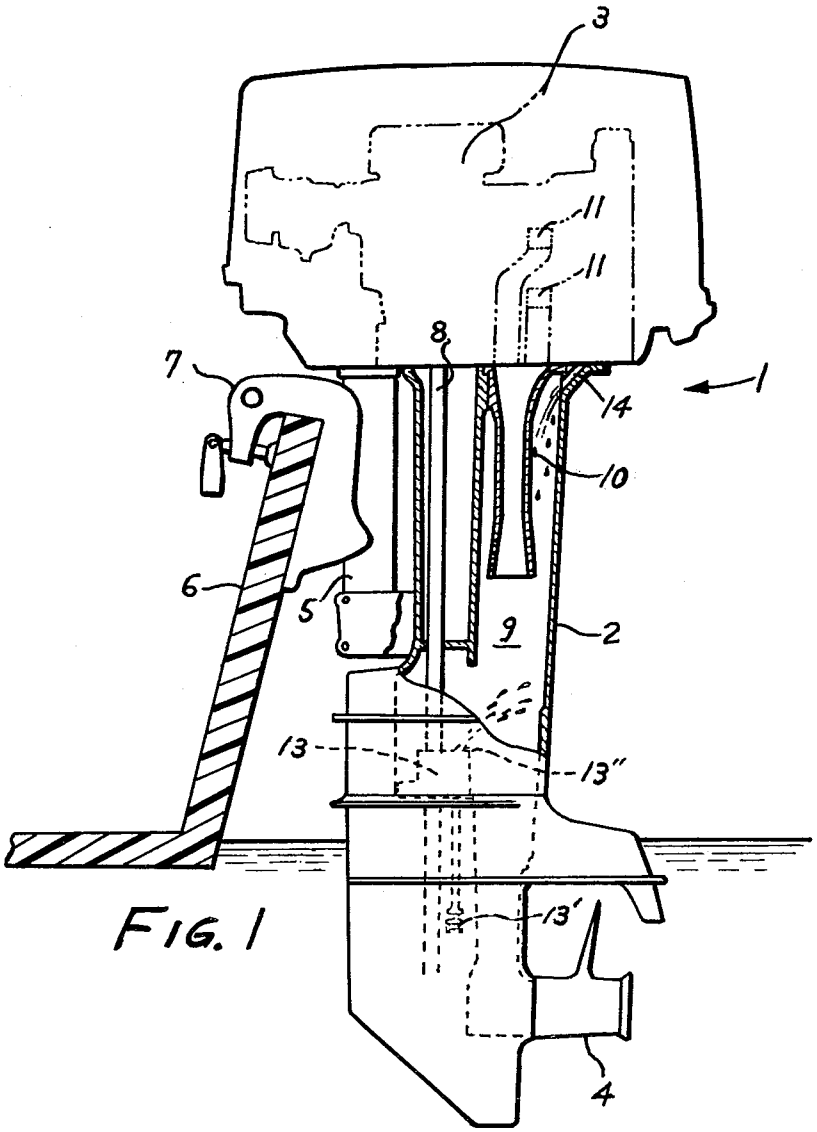
FIG. 1 is a side view showing one embodiment of the present invention partially in sections.

In FIG. 1, reference numeral 1 indicates a propulsion unit, which is equipped with a casing 2, a two-cycle engine 3 having two upper and lower cylinders mounted on the upper portion of the casing 2, and a propeller 4 disposed in the lower portion of the casing 1.

The propelling unit 1 thus constructed is mounted to a bearing 5, which is made integral with a swivel bracket (not shown), so that it can rotate to the right and left. The swivel bracket is supported in a vertically swinging manner on a clamp bracket 7 which is fixed to the transom of a vessel hull.

Within the casing 2, there is disposed at the closer side to transom 6 a substantially upright drive shaft 8, by which the rotations of the aforementioned engine 3 are transmitted to the propeller 4. At the opposite side from transom 6, there is provided an exhaust expansion chamber 9 which has its lower portion communicating with water through an exhaust hole formed in the bass of the propeller 4. Indicated at numeral 10 is an exhaust pipe which has its upper end so fixed as to have communication with the exhaust ports 11 and 11 of the engine while depending and protruding into the expansion chamber 9.

Figure 2:
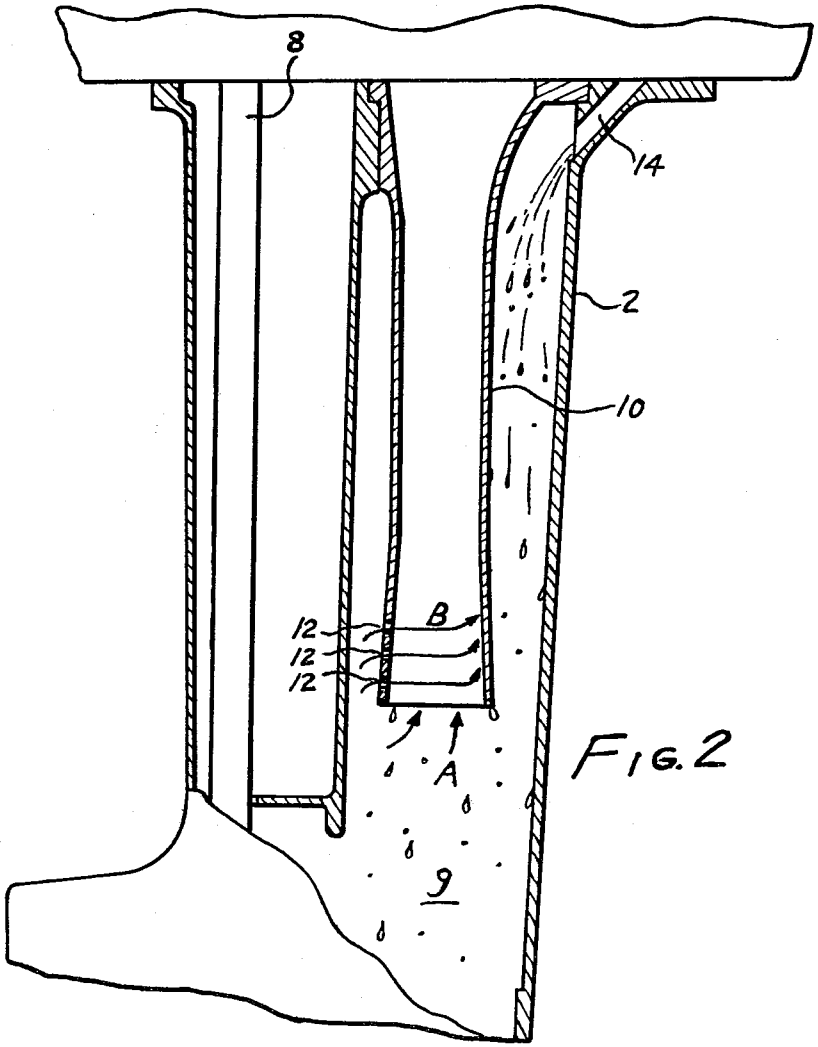
FIG. 2 is an enlarged view showing a portion thereof.

As best shown in FIG. 2, exhaust pipe 10 has its lower wall formed according to the present invention with pores 12 which are arranged at a suitable spacing in the longitudinal direction.

Indicated at numeral 13 is a water pump which is disposed in the exhaust expansion chamber 9 and which is driven by the drive shaft 8. This water pump 13 sucks water from a water inlet 13', which is disposed in the water, and pumps cooling water to the engine 3 through a pipe (not shown). Then, the cooling water having been used to cool the engine parts is discharged into the exhaust expansion chamber 9 from an outlet port 14 which is formed in the upper portion of the casing 2. Incidentally, the water pump 13 is formed with an injection port 13'', through which some cooling water which otherwise would be pumped to engine 3 is injected into the expansion chamber 9, thereby to cool the wall surface of the expansion chamber exposed to the exhaust gases and also to cool a rubber damper disposed in the boss of the propeller 4.

As a result, the cooling water, which has been discharged into the expansion chamber 9 from the outlet port 14 or from injection port 13'' of the water pump 13 thereby to cool the necessary portions, is discharged into the water, passing out through the boss of the propeller 4 together with the exhaust gases which are discharged into expansion chamber 9 from exhaust pipe 10.

The operations of the exhaust system thus constructed will now be described with further reference to FIG. 2.

Under engine running conditions, cooling water is pumped by water pump 13 to engine 3, thereby to cool the respective portions. After that, the cooling water is discharged into the exhaust expansion chamber 9 from the outlet port 14 so that it is finely splashed (i.e., divided into droplets) to expand in said expansion chamber 9 until it partially wets the outer circumferencial wall of the exhaust pipe 10. From the injection port 13'' of the water pump 13, a portion of the cooling water is also injected and splashed into the expansion chamber 9.

From the exhaust pipe 10, on the other hand, the exhaust gases are discharged into the expansion chamber 9. And, these exhaust gases are guided to the lower portion of the casing together with the cooling water drifting in the expansion chamber until they are discharged into the water through the propeller 4.

Now, the following phenomena are found in the exhaust pipe 10.

The high pressure waves, which are generated at the instant when the exhaust port 11 of the engine 3 is opened, are propagated in said exhaust pipe 10 toward the leading end thereof. These positive pressure waves are changed, at the instant when they expand from the leading end of the exhaust pipe into the expansion chamber 9, into negative pressure waves, which in turn return toward the exhaust port 11 through the exhaust pipe 10, thus establishing the pulsating phenomena of the positive and negative pressure waves. As a result, when a vacuum is established in the exhaust pipe 10, the aforementioned water droplets drifting in the vicinity of the lower end of the exhaust pipe and/or the water droplets wetting the outer circumferential wall of the exhaust pipe 10 or reaching the opened lower end of the exhaust pipe along the wall surface may be sucked into the exhaust pipe 10 together with the exhaust gases, as shown by arrow A in FIG. 2.

In the present embodiment, however, the exhaust pipe 10 is made with its lower wall formed with three pores 12 (perforations) which are arranged at a suitable spacing in the longitudinal direction. As a result, when a vacuum is established in the exhaust pipe, the exhaust gases in the expansion chamber 9 are sucked through those pores 12 into the exhaust pipe 10 such that they flow to cross the exhaust pipe 10, as shown in arrows A, in a direction which is substantially perpendicular to the axial direction of said pipe 10. As a result, even if the water droplets are sucked into the exhaust pipe 10 together with the exhaust gases, as shown in the arrow A, the flows (shown by arrows B) of the exhaust gases, which are sucked through the pores 12, form a kind of air curtain to block the flow exemplified by arrows A, thereby to block further rise of the water droplets. Although, incidentally, it is conceivable that a few droplets may steal into the exhaust pipe 10 through the pores 12, their flow rate is restricted to a small value because the pores 12 have a small diameter. Moreover, since the flow is directed to cross the axis of the exhaust pipe 10 at a right angle, the water droplets rise in the exhaust pipe 10 at such a negligible rate as to raise no problem. As a result, it is possible to prevent the water droplets sucked into the exhaust pipe from stealing into the engine cylinder. This averts misfires, and prevents the salt content of sea water used for cooling from wetting the inner wall of the exhaust pipe which could invite corrosion or cause and increase in the passage resistance.

In the embodiment thus far described, incidentally, the three pores 12 are arranged in the suitable spacing in the axial direction of the exhaust pipe 10, but the present invention is not to be limited to such construction arrangement. In other words, the number of the pores is arbitrary, and the pores themselves can be arranged not only in the axial direction but also in the circumferential direction of the exhaust pipe.

Incidentally, the level to which the water droplets may rise in the exhaust pipe 10 is determined by the positions of the pores. From the standpoint of intending to prevent the inner wall of the exhaust pipe from being wetted with the cooling water (or the brine in the case of the sea water) as much as possible, therefore, it is preferred that the positions of the pores 12 be as close as possible to the lower end of the exhaust pipe 10.

As has been described hereinbefore, according to the present invention, since the exhaust pipe protruding into the exhaust expansion chamber is made to have its lower end formed with the pores extending therethrough, even if a vacuum is established in the exhaust pipe so that the water droplets drifting in the exhaust expansion chamber and/or the water droplets wetting the outer circumferential wall of the exhaust pipe and reaching the leading end of the exhaust pipe along the wall surface thereof are sucked into the exhaust pipe, they can be prevented from further rising by the flows of the exhaust gases through the pores. As a result, it is possible to eliminate such difficulties as are experienced in the prior art, namely that the water droplets steal into the engine cylinder thereby to cause the misfire or that the cooling water (or the brine in the case of sea water) wets the inner wall of the exhaust pipe thereby to invite corrosion or the increase in the passage resistance.

With the use of such a simple construction as is formed with the pores, moreover, it is also possible to provide an exhaust system which can be produced easily at a low cost.

This invention is not to be limited by the embodiment shown in the drawings and described in the description, which is given by way of example and not of limitation, but only in accordance with the scope of the appended claims.

What is claimed is:

1. In an outboard engine assembly which includes a casing, an internal combustion engine having a water coolant circuit and an exhaust pipe, said casing enclosing an expansion chamber into which said exhaust pipe projects and into which it discharges engine exhaust gases, said exhaust pipe having an outlet end in said expansion chamber and a peripheral wall which is, for a substantial portion of its length immediately adjacent to its outlet end, exposed directly to said gases in said expansion chamber, at least part of the coolant water from said circuit being also discharged into said expansion chamber so as to contact at least part of said exposed portion of said exhaust pipe, the improvement comprising a plurality of pores extending through said peripheral wall near said outlet end of said exhaust pipe, whereby to permit flow of gases from said expansion chamber into and across said exhaust pipe, to discourage backflow of said exhaust gases through said outlet end and into said exhaust pipe.

2. Apparatus according to claim 1 in which said exhaust pipe has an axis, and in which said pores are axially aligned and spaced from one another.

3. Apparatus according to claim 1 in which said pores are peripherally disposed and spaced from one another.

4. Apparatus according to claim 1 in which said water coolant circuit includes a water pump which discharges some water directly into said expansion chamber.

5. Apparatus according to claim 1 in which said water coolant circuit discharges water which has cooled said engine toward said exhaust pipe.

6. Apparatus according to claim 5 in which said water coolant circuit includes a water pump which discharges some water directly into said expansion chamber.

7. Apparatus according to claim 1 in which said pores are spaced relatively close to one another whereby to form a curtain of cross flowing gases across said exhaust pipe.

8. Apparatus according to claim 1 in which said coolant water is discharged into said expansion chamber through a port at one side of said exhaust pipe, and said pores open into said chamber at the opposite side therefrom.

9. Apparatus according to claim 1 in which said outlet end is not occluded or obstructed, and faces downwardly.

* * * * *